US006135935A

United States Patent [19]

Kivioja et al.

[11] Patent Number: 6,135,935

[45] Date of Patent: Oct. 24, 2000

[54] CLOSING VALVE FOR A REGULATION VALVE OF A VARIABLE-CROWN ROLL IN A PAPER MACHINE AND A VARIABLE-CROWN ROLL INCLUDING THE SAME

[75] Inventors: Pekka Kivioja, Muurame; Juha Laitinen, Jyväskylä, both of Finland

[73] Assignee: Valmet Corporation, Finland

[21] Appl. No.: 09/213,677

[22] Filed: Dec. 17, 1998

[30] Foreign Application Priority Data

Dec. 17, 1997 [FI] Finland ..... 974540

[51] Int. Cl.[7] ..... F16K 31/00

[52] U.S. Cl. ..... 492/20; 251/347

[58] Field of Search ..... 492/20, 7; 251/318, 251/347; 162/305

[56] References Cited

U.S. PATENT DOCUMENTS 2,330,127 9/1943 Lehmberg .
4,270,727 6/1981 Norman ..... 251/63.4
4,316,481 2/1982 Fillman .
5,010,913 4/1991 Guerster et al. ..... 242/378.1
5,158,105 10/1992 Conway ..... 137/296

*Primary Examiner*—David P. Bryant
*Assistant Examiner*—Marc W. Butler
*Attorney, Agent, or Firm*—Steinberg & Raskin, P.C.

[57] ABSTRACT

A closing valve for a regulation valve of a roll in a paper machine, such as a variable-crown roll, including a frame part arranged between the regulation valve of a regulation valve block and a block frame and in which pressure medium ducts are formed. The closing valve includes a connecting part movable in relation to the frame part and having closing members mounted thereon and which are arranged to extend into the pressure medium ducts in the frame part. When the connecting part is displaced in relation to the frame part, the closing members attached to the connecting part close and open the pressure medium ducts in the frame part. A variable-crown roll including one or more closing valves is also disclosed.

16 Claims, 5 Drawing Sheets

141
142
143
CZ
Z1-Z24

CZ
MCZ
A
B
P
T
X
Y
201

Z1
101
120
100
SV1
MZ
MZ1
A
B
P
T

BHP
C7
Z1
Z2
Z22
Z23
Z24
MP
MT
MI
TMZ
131

$X_2 - X_2$ $X_1 - X_1$

CLOSING VALVE FOR A REGULATION VALVE OF A VARIABLE-CROWN ROLL IN A PAPER MACHINE AND A VARIABLE-CROWN ROLL INCLUDING THE SAME

FIELD OF THE INVENTION

The present invention relates generally to a closing valve for a regulation valve of a roll in a paper machine roll including a block frame having pressure medium ducts through which pressure medium is passed to the regulation valve, and more particularly, to a closing valve for a regulation valve of a variable-crown roll.

The present invention also relates to a variable-crown roll including a block frame, regulation valves and closing valves, each closing valve being interposed between the block frame and a respective regulation valve.

BACKGROUND OF THE INVENTION

In a paper machine environment, in order to measure a force, for example, a linear load, the pressure is usually measured. Pressure transmitters or detectors act as feedback members of force regulation circuits. In present-day lines of manufacture of paper, there are, on the average, about 500 points at which the pressure is measured. Consequently, there are a large number of regulation valves related to the regulation of pressure.

One application in which a large number of regulation valves are used is a variable-crown roll in a paper machine. A variable-crown roll is usually divided into a number of regulation zones in its axial direction. In each regulation zone, there are several loading elements interposed between the roll axle and an inner face of the roll mantle. By means of the loading elements, the curve form of the roll mantle at the nip point can be regulated. Each regulation zone is controlled by means of a regulation valve of its own. Regulation valves fail from time to time, but the failure of one regulation valve does not necessarily require that the variable-crown roll and the process connected with it has to be stopped immediately. Rather, since there are a large number of regulation zones in a variable-crown roll, the roll can be operated very well for a short period of time even if one regulation valve has failed. Replacement of a broken regulation valve has, however, so far, required stopping of the machine, because it has not been possible to close the pressure and tank ducts passing to the regulation valve. For this reason, there has been a need of a system in which a broken regulation valve can be replaced by a new one during running of the machine. One solution to this problem is to provide the regulation valves with closing valves by whose means the pressure and tank ducts passing to the regulation valve can be closed for the time of replacement of the regulation valve.

In the market, closing valves are available which can be connected with regulation valves and by whose means the pressure and tank ducts passing to the regulation valves can be closed for the time of replacement of a regulation valve. The closing valves available on the market are, however, large and, for example, closing valves meant for closing of a regulation valve provided with four pressure medium ducts comprise at least three valves that must be closed separately. Further, the operating members of these closing valves are opened on two different faces of the closing valve so that their operation requires that there is free access to the closing valves from two different directions. Such closing valves available on the market are thus suitable for use in systems that comprise just a few regulation valves, and, moreover, there must be an abundance of free space around the regulation valves. On the other hand, these closing valves are not suitable for use in hydraulic systems of variable-crown rolls, in which a large number of regulation valves are packed in a space as compact as possible, in the which case the free space around the regulation valves is highly limited. Since the closing valves available on the market comprise several valves, all of which must be closed when a broken regulation valve is replaced, such valves also involve a safety risk to the workers. If even just one valve has remained open as a result of an error, pressurized fluid is discharged through this avlve when the broken regulation valve is removed, in which connection, the health of the maint eonnel is endangered.

OBJECTS AND SUMMMY OF THE INVENTION

Accordingly, it is an object of the present invention to provide a closing valve for a regulation valve of a variable-crown roll in a paper machine.

It is another object of the present invention to provide a closing valve for a regulation valve of a roll in a paper machine which can be installed in a block of in connection with tightly packed regulation valves.

It is still another object of the present invention to provide a closing valve for a regulation valve of a roll in a paper machine which can be operated from one direction.

It is yet another object of the present invention to provide a new and improved closing valve in which the drawbacks of prior art closing valves, such as those discussed above, are substantially avoided.

It is still another object of the present invention to provide new and improved variable-crown rolls for a paper machine.

In order to achieve these objects and others, the closing valve in accordance with the invention includes a frame part adapted to be arranged between the block frame and a regulation valve and includes pressure medium ducts through which pressure medium flows between the block frame and the regulation valve, a connecting part movable relative to the frame part, and closing members mounted on connecting part and arranged to extend into the pressure medium ducts in the frame part. Movement of the connecting part relative to the frame part closes and opens the pressure medium ducts in the frame part and thus controls the flow of pressure medium between the block frame and the regulation valve.

By means of the closing valve in accordance with the invention, the typical four pressure medium ducts connected with the regulation valve of a variable-crown roll can be closed by turning one actuator member, and by means of the closing valve construction in accordance with the invention a fully non-leaking valve is obtained when the valve is closed.

Further, the closing valve in accordance with the invention has a small size, and it can be installed directly between the existing regulation valves of the variable-crown roll and the main block. It can be attached directly to the fastening points provided on the main block for the regulation valve, and the regulation valve can again be attached directly to the fastening points provided on the closing valve. Thus, no alterations have to be made to the existing components.

The closing valve in accordance with the invention is also commercially competitive.

The invention will be described in detail with reference to some preferred embodiments of the invention illustrated in the figures in the accompanying drawing. However, the invention is not confined to the illustrated embodiments alone.

BRIEF DESCRIPTION OF THE DRAWINGS

Additional objects of the invention will be apparent from the following description of the preferred embodiment thereof taken in conjunction with the accompanying non-limiting drawings, in which.

DETAILED DESCRIPTION OF THE PREFERRED EMBODIMENTS

Figures 1A, 1B, 1C, 1D:
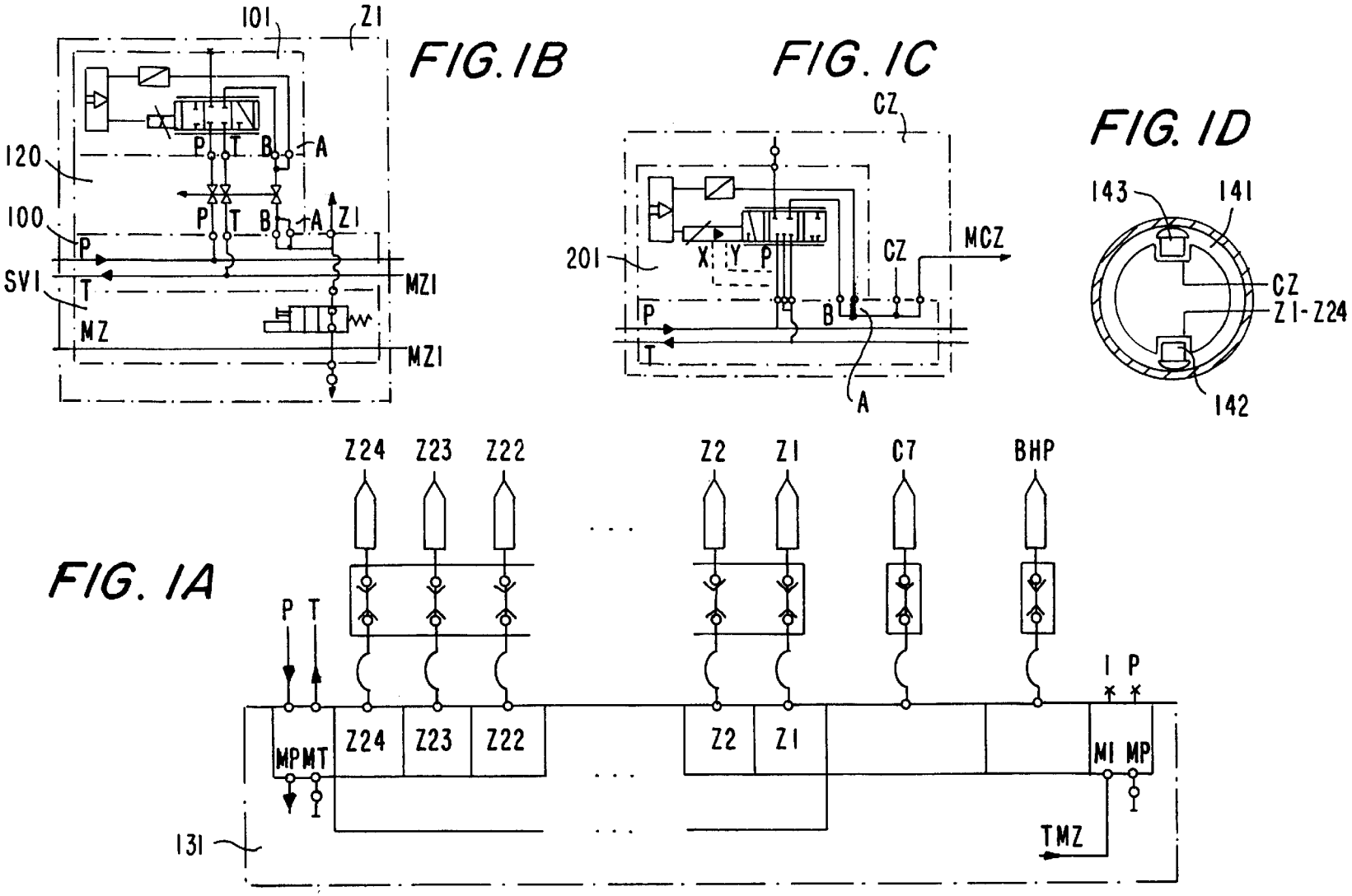
FIGS. 1A–1D shows hydraulic diagrams related to the regulation circuits of a variable-crown roll in a paper machine, which diagrams show the principal parts of the regulation circuits.

Referring to the accompanying drawings wherein like reference numerals refer to the same or similar elements, FIGS. 1A–1D illustrate hydraulic diagrams of a variable-crown roll in a paper machine, in which the principal parts of the regulation circuits are seen. More specifically, FIG. 1A shows the main block 131, FIG. 1B shows the regulation devices connected with one regulation zone Z1, FIG. 1C shows the regulation devices connected with the backup zones CZ, and FIG. 1D is a sectional view illustrating the principle of a variable-crown roll 141.

In this exemplifying embodiment, the variable-crown roll has been divided, in its axial direction, i.e., across the width of the paper web, into separately adjustable regulation zones or circuits Z1, . . . , Z24. Each regulation zone Z1, . . . , Z24 includes a number of hydraulic loading elements 142 installed between the roll axle and an inner face of the roll mantle. By means of the loading elements 142, bending of the roll mantle can be varied. Loading elements 142 are directed at the nip point of the roll. At the opposite side of the roll, in relation to the nip point, loading elements 143 are arranged between the roll axle and the inner face of the roll mantle. Loading elements 143 are situated in what is called backup zones or circuits CZ, and these backup zones CZ are normally provided exclusively at the ends of the roll (although they are not limited to such placement). By means of the loading elements 143 provided in the backup zones CZ, the regulation of the linear load at the nip point of the roll can be adjusted so as to achieve further precision.

FIG. 1A shows the main block 131 to which regulation circuits Z1, . . . , Z24 and CZ are connected. Further, a regulation circuit BPH departing to the bearings is connected to the main block 131. In the top portion at the left side of the main block 131, the ducts passing to the pressure medium source P and to the tank line T are shown. Opposite to these ducts, additionally the measurement point MP for the feed pressure of the pressure medium source is shown (to which measurement point a reference pressure detector can be connected), and the point MT is shown, which passes to the tank line T. In the top portion at the right side of the main block 131, similarly, alternative connections passing to the pressure medium source P and to the tank line T are shown, which connections have been provided with plugs. Opposite to these connections, the connection of the pressure limiter valve TMZ (not shown in the figures) with the tank line MT and the connection with the pressure medium feed line MP are shown.

FIG. 1B shows the regulation devices connected with one regulation zone Z1, i.e., a regulation valve 101, a closing valve 120, a block frame 100 of the regulation block, and a seat valve SV1. Pressure medium ducts A and B departing from the regulation valve 101 are connected through a duct or line Z to the loading elements 142 of one regulation zone Z1 in the variable-crown roll. In the regulation valve block frame 100, a pressure medium duct P passing to the pressure source (not shown in the figure) and a pressure medium duct T passing to the pressure medium tank (not shown in the figure) are provided. From the pressure medium duct Z that passes to the variable-crown roll, there is also a connection through the seat valve SV1 to the pressure medium duct MZ, which passes to the reference pressure detector PT (not shown in the figure).

FIG. 1C shows the regulation circuit connected with the backup zone CZ in the variable-crown roll. The pressure medium ducts A and B departing from a regulation valve 201 are connected through a line to the backup zone CZ in the variable-crown roll. The number of these backup zones CZ is normally two, one at each end of the roll. In such a case, each backup zone is controlled by means of a regulation circuit of its own, whose pressure settings are kept equal. Further, the pressure medium ducts A and B departing from the regulation valve 201 can be connected through the line MCZ, by means of a seat valve, to the reference pressure transmitter (not shown in the figure).

FIG. 1D illustrates the connections of the outputs of the regulation valves 101,201 of the regulation circuits of zones Z1, . . . , Z24 and CZ to the variable-crown roll 141. Each regulation circuit of zones Z1, . . . , Z24 is connected to the loading elements 143 in the regulation zone concerned, and each regulation circuit of backup zone CZ is connected in a similar way to the loading elements 142 in the backup zone concerned.

From the point of view of the present invention, the regulation block Z1 connected with the regulation zones Z1, . . . , Z24 and the closing valve 120 provided in the regulation block are the subject of primary interest, and this will be described in the following with reference to FIGS. 2A–5B.

Figure 2B:
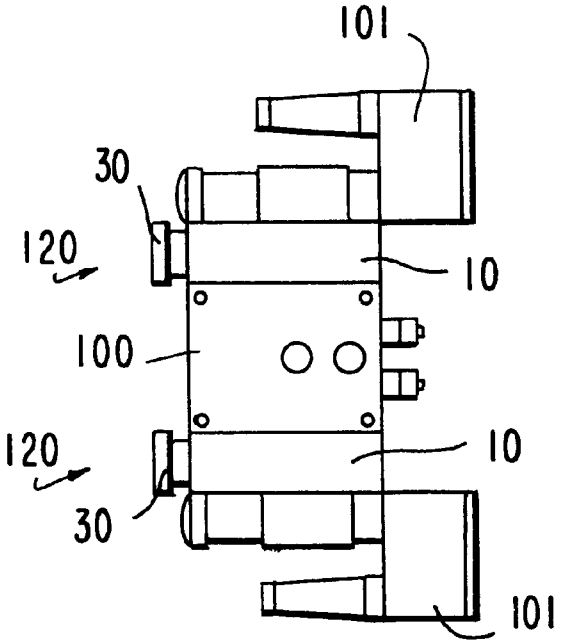
FIGS. 2A and 2B are schematic illustrations of a regulation valve block of a variable-crown roll in which the closing valve in accordance with the invention can be used.
Figure 2A:
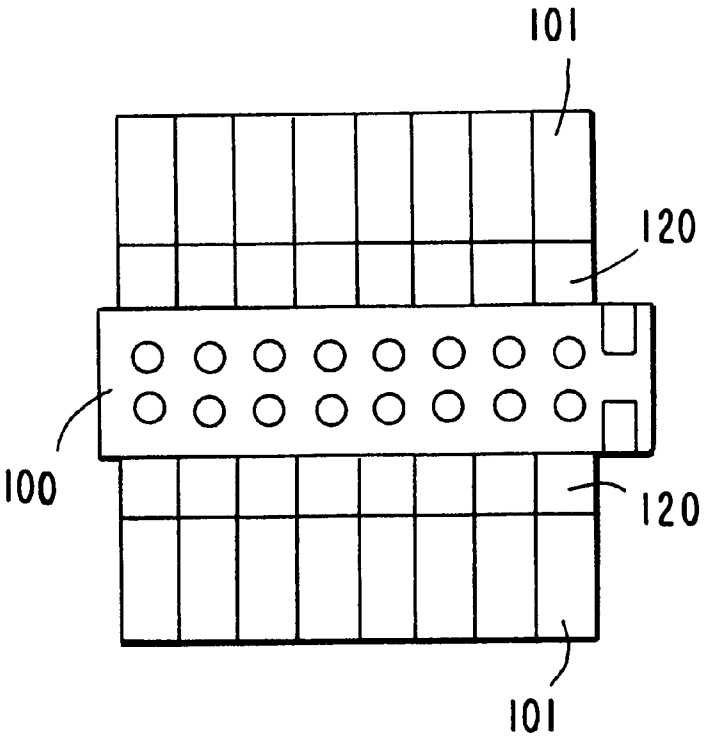

In FIG. 2A, the regulation valve block is shown as viewed from above, and in FIG. 2B as viewed from the end. Thus, in the regulation valve block, there are a number of regulation valves 101 arranged side by side in the block frame 100 at opposite sides of the frame. Into the block frame 100, longitudinal pressure medium ducts have been formed, from which there are ducts passing in the cross direction to each of the regulation valves 101. The closing valve 120 in accordance with the present invention is arranged between the block frame 100 of the regulation valve block and each regulation valve 101.

Figure 3B:
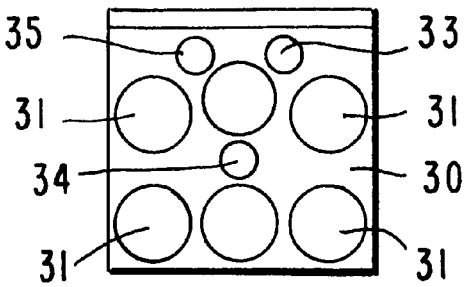
FIGS. 3A–3C are schematic illustrations of a closing valve in accordance with the invention.
Figure 3C:
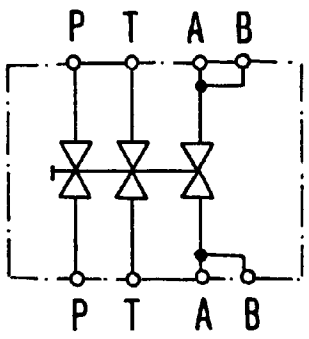
Figure 3A:
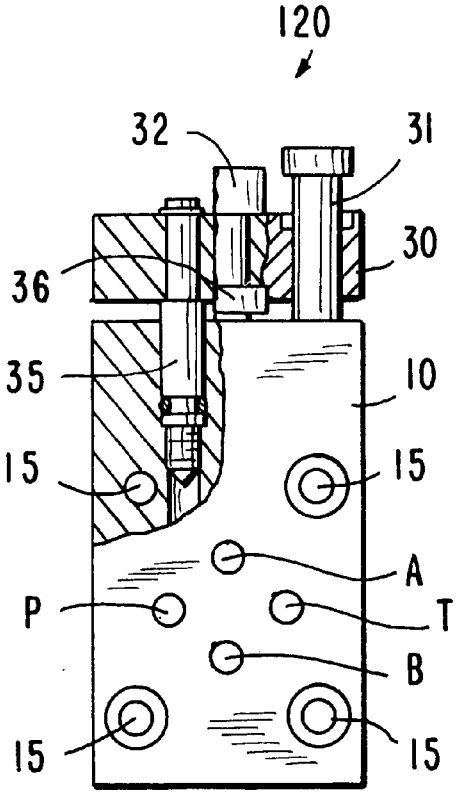

FIG. 3A shows the closing valve 120 in accordance with the invention as a side view, and FIG. 3B as viewed from above. Further, FIG. 3C shows a hydraulic diagram of the closing valve. The closing valve 120 in accordance with the invention comprises a generally parallelepiped-shaped frame part 10 as well as a connecting part 30 which is also substantially shaped as a parallelepiped and which moves in relation to the frame part 10. Four bores 15 extend through the frame part 10 and enable the frame part 10 to be attached by means of fastening means, e.g., hexagonal socket head screws, to the block frame 100 of the regulation valve block. Further, the frame part 10 includes the pressure medium ducts P, T, A, B.

The connecting part 30 includes bores, through which four guide devices 31, e.g., guide screws, extend, which screws have been attached to the threaded bores that receive the guide screws 31 and that are provided in the frame part 10. The function of the guide devices 31 is to operate as guides, bearings and supports when the connecting part 30 is displaced in relation to the frame part 10 by means of a screw member 32 attached to the connecting part 30 by means of a locking ring 36. In the frame part 10, there is a bore 37 provided with a threading that receives the screw member 32 so that by rotating the screw member 37, connecting part 30 is moved relative to frame part 10. Other guide means instead of guide devices 31 may be used in the invention for guiding movement of the connecting part relative to the frame part. Also, other displacement means instead of screw member 32 may be used in the invention for causing displacement of the connecting part relative to the frame part. Further, three elongate closing members 33, 34, 35 are attached to the connecting part 30, which closing members move along with the connecting part 30 in bores fitted in the frame part, each bore being arranged to receive a respective one of the closing members 33, 34, 35. Closing members 33, 34, 35 are preferably arranged to move into and out of the respective pressure medium duct in the frame part 10 such that all of the pressure medium ducts are closed or opened simultaneously.

From the hydraulic diagram in FIG. 3C it is seen that the closing members 34, 35, 36 close the pressure medium ducts P, T, A and that the pressure medium ducts A and B are interconnected at both sides of the closing valve, i.e., ducts A and B have a common duct portion into which the closing member 34 extends. This is accomplished in the closing valve 120 so that, inside the frame part 10 of the closing valve, at the side 10*a* next to the regulation valve 101, the ducts A and B have been interconnected, after which the combined duct is passed through the closing branch to the side 10*b* of the closing valve placed at the side of the block frame 100, where the combined duct is again branched into separate ducts A, B. The construction of the regulation valve 101 is such that an equal pressure is effective in the ducts A and B. In the regulation valve 101, both ducts A and B are used in order to increase the flow capacity. The combining of the ducts A and B, of course, produces a local throttle and flow losses but is utilized because there is not sufficient space for four separate closing branches in the closing valve.

Figure 4B:
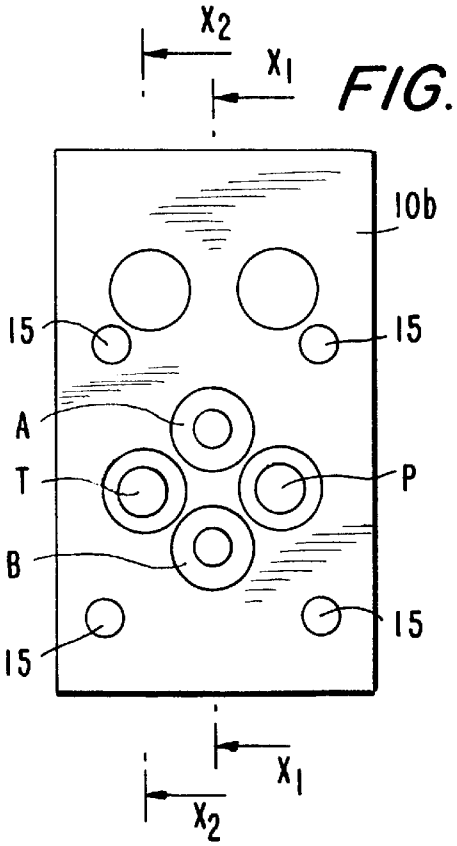
FIGS. 4A–4D are more detailed illustrations of the frame part of the closing valve in accordance with the invention.
Figure 4D:
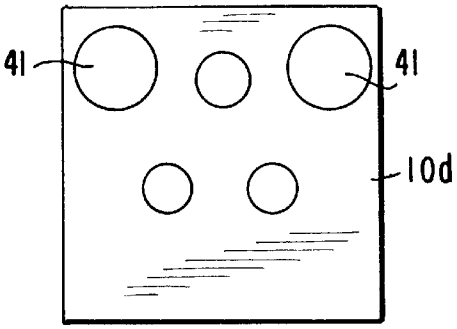
Figure 4C:
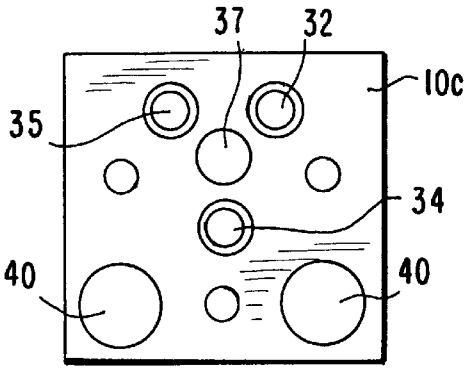
Figure 4A:
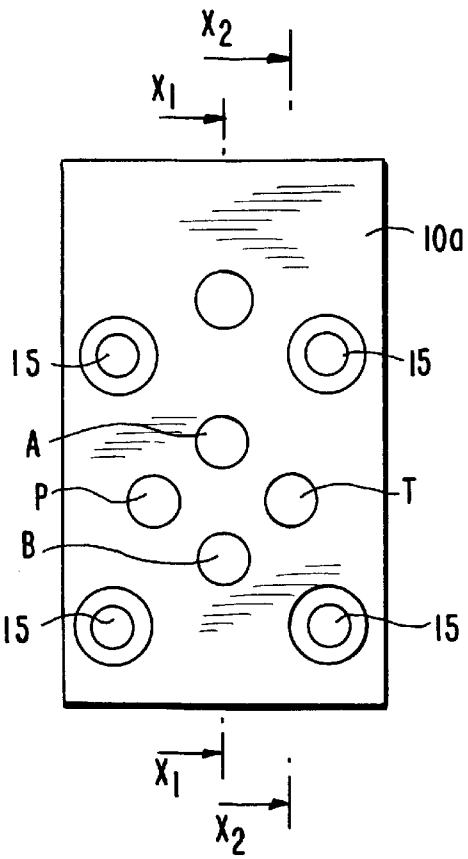

FIG. 4A shows the frame part 10 of the closing valve as viewed from its side 10*a* next to the regulation valve 101, FIG. 4B as viewed from its side 10*b* next to the block frame, FIG. 4C as viewed from its top side 10*c*, and FIG. 4D shows the frame part 10 as viewed from its bottom side 10*d*. At the side 10*a* of the closing valve placed at the side of the regulation valve 101 and at the side 10*b* placed at the side of the main block, the bores 15 are shown which extend through the closing valve perpendicularly to the faces of sides 10*a*, 10*b*. By means of the bores 15, the frame part 10 of the closing valve may be attached to the block frame 100, for example, by means hexagonal socket head screws. At the side 10*a* next to the regulation valve 101, the bores 15 are provided with recesses having a larger diameter. When the frame part 10 is attached to the block frame 100, the heads of the hexagonal socket head screws sink into the bores 15 with enlarged initial ends, in which case a free bore portion remains between the face of the side 10*a* of the frame part 10 placed at the side of the regulation valve 101 and the head of the hexagonal socket head screw. Bores 40 extend into the free hole portions of the bores 15 placed at a higher level and are formed perpendicular to the top face 10*c* of the frame part 10 (FIG. 4C). Similarly, into the free hole portions of the bores 15 placed at a lower level, bores 41 extend which are formed perpendicular to the lower face 10*d* of the frame part 10 (FIG. 4D). Threaded pins are placed into these bores 40 and 41, whose opening intersects the free holes, and when the threaded pins are pushed into the bottom, the threaded hole provided in the pin is placed at the same location as the threaded hole that was provided in the block frame 100, into which hole the frame part 10 of the closing valve was attached. After this, the regulation valve 101 can be attached against the face of side 10*a* of the frame part 10 of the closing valve by means of screws that extend into the threaded holes in the threaded pins.

At the side 10*a* of the closing valve placed at the side of the regulation valve 101 and at the side 10*b* placed at the side of the block frame 100, the pressure medium ducts P, T, A, B are shown, which are placed one opposite to the other, but which do not extend directly through the frame part 10 of the closing valve. The pressure medium ducts P, T, A, B extend both from the face 10*a* at the side of the regulation valve 101 and from the face 10*b* at the side of the block frame 100 a certain distance straight into the interior of the frame part 10. Connection of the ducts P, T, A, B is accomplished by means of additional bores which are formed from the top side 10*c* and from the bottom side 10*d* of the frame part 10 and from the side 10*a* placed at the side of the regulation valve 101 and from the side 10*b* at the side of the block frame 100.

Figure 5B:
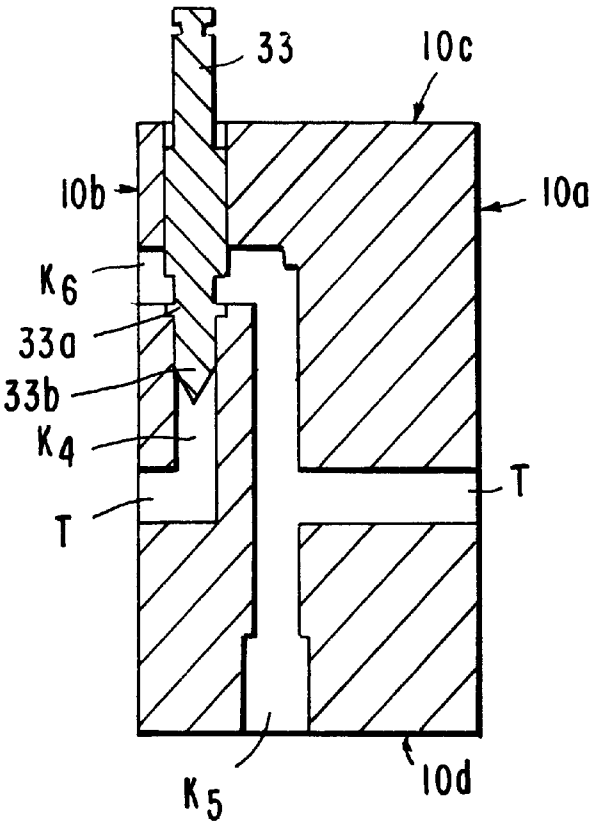
FIG. 5B shows a sectional view taken along the line $X_2$—$X_2$ in FIGS. 4A and 4B, which view shows the passing of the pressure medium ducts in the frame part of the closing valve.
Figure 5A:
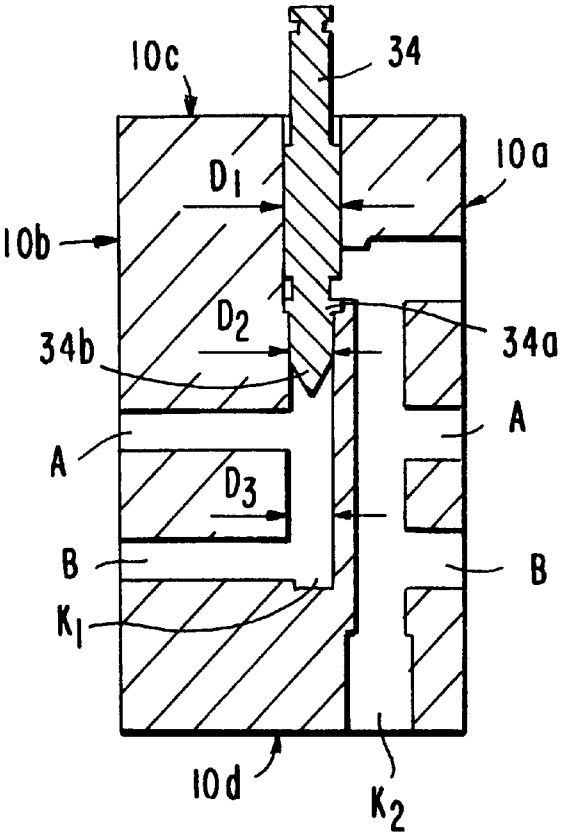
FIG. 5A shows a sectional view taken along the line $X_1$—$X_1$ in FIGS. 4A and 4B, which view shows the passing of the pressure medium ducts in the frame part of the closing valve.

FIGS. 5A and 5B show the running of the pressure medium ducts P, T, A, B in the frame part 10 of the closing valve. Bores A, B are formed in the frame part 10 of the closing valve from the side 10*a* placed at the side of the regulation valve. Bores A, B placed one above the other at a distance from one another, which are perpendicular to the outer face of the side 10*a*, and which extend a certain distance into the frame 10. Further, into the frame part 10 of the closing valve, from the side 10*b* placed at the side of the block frame 100, bores A, B have been formed, which are placed opposite to the bores mentioned above and which also extend a certain distance into the frame part 10. Thus, bores A, B made from the side 10*a* placed at the side of the regulation valve 101 and those made from the side 10*b* placed at the side of the block frame 100 are placed one opposite to the other, but the connection between them has been formed by means of additional bores made from the top face 10*c* of the frame part 10, from the bottom face 10*d*, and from the face 10*a* placed at the side of the regulation valve 101.

The bores A, B are connected with three additional bores $K_1$, $K_2$ and $K_3$. By means of the first additional bore $K_1$, the bores A, B placed at the side 10*b* next to the block frame 100 are interconnected, and by means of the second additional bore $K_2$, the bores A, B placed at the side 10*a* next to the regulation valve 101 are interconnected, By means of the third additional bore $K_3$, the additional bores $K_1$, $K_2$ are interconnected. Bore $K_1$ perpendicular to the top face 10*c* is formed into the top face 10*c* of the frame part 10 and extends into the bores A, B made from the side 10*b* placed next to the block frame 100 and interconnects these bores. Into the bottom face 10*d* of the frame part 10, the bore $K_2$ perpendicular to the bottom face 10*d* has been formed, which bore extends into the bores A, B made from the side 10*a* placed next to the regulation valve 101 and interconnects these bores. The bore $K_2$ further extends a certain distance above the upper bore A made from the side 10*a* placed next to the regulation valve 101. Further, into the frame part 10, from the side 10*a* placed next to the regulation valve 101, above the bore A, the bore $K_3$ is formed and extends into the bores $K_1$ and $K_2$, whereby a connection is formed between the bores $K_1$ and $K_2$. The opening of the bore $K_2$ opening at the bottom face 10*d* of the frame part 10 is closed by means of a plug. When the closing valve is placed in its position, the opening of the bore $K_3$ opening at the face 10*a* of the frame part 10 placed next to the regulation valve 101 is closed against the face of the regulation valve 101.

Through the top face 10*c* of the frame part 10, a closing member 34 is placed in the bore $K_1$, whereby the construction illustrated in the hydraulic diagram in FIG. 3C is obtained in respect of the pressure ducts A and B. When the closing member 34 is in the position shown in FIG. 5A, i.e., in the closed position, the connection between the pressure ducts A, B at the side 10*a* of the frame part 10 placed next to the regulation valve 101 and the pressure ducts A, B placed at the side 10*b* of the frame part 10 placed next to the block frame 100 is closed. The closing and sealing take place by means of a conical face 34*b* provided at the bottom end of the closing member 34. When the closing member 34 rises, the connection provided by the bore $K_3$ between the bores $K_1$ and $K_2$ is opened, and the connection in the pressure ducts A, B between the regulation valve 101 and the block frame 100 is opened.

FIG. 5B illustrates the formation of the pressure medium duct T. From the side 10*a* of the frame part 10 placed next to the regulation valve 101, a bore T has been formed which extends a certain distance perpendicularly to the face of the side 10*a* into the frame part 10, and from the side 10*b* placed next to the block frame 100, another bore T has been formed, which is placed opposite to the first bore and which also extends a certain distance into the frame part 10. An additional bore $K_4$ is formed into the top face 10*c* of the frame part 10 perpendicular thereto and extends into the bore T that has been formed from the side 10*b* of the frame part 10 placed next to the block frame 100. An additional bore $K_5$ is formed into the bottom face 10*d* of the frame part 10 perpendicular thereto and extends into the bore T that has been formed from the side 10*a* placed next to the regulation valve 101 and extends a certain distance upwards from this bore towards the top face 10*c* of the frame part 10. From the side 10*b* placed next to the block frame 100, a bore $K_6$ is formed above the bore T and extends into the bore $K_4$ and into the bore $K_5$ so that a connection is formed between the bores $K_4$ and $K_5$. The opening of the bore $K_5$ that opens at the bottom face 10*d* of the frame part 10 is closed by means of a plug. When the closing valve is placed in its position, the opening of the bore $K_6$ that opens at the side 10*b* of the frame part 10 placed next to the block frame is closed against the solid face of the block frame 100.

Closing member 33 is placed into the bore $K_4$ so that the construction shown in FIG. 3C is obtained in respect of the pressure duct T. When the closing member 33 is in the position shown in FIG. 5B, i.e., in the closed position, the connection between the pressure duct T at the side 10*a* of the frame part 10 placed next to the regulation valve 101 and the pressure duct T placed at the side 10*b* of the frame part 10 placed next to the block frame 100 is closed. The closing and sealing take place by means of a conical face 33*b* provided at the bottom end of the closing member 33. When the closing member 33 rises, the connection provided by means of the bore $K_6$ between the bores $K_4$ and $K_5$ is opened, and the connection in the pressure duct T between the regulation valve 101 and the block frame 100 is opened.

The pressure duct P has been formed in the same way as the pressure duct T described above. A sectional view illustrating the pressure duct P and corresponding to FIG. 5B would be identical with the sectional view in FIG. 4B.

The diameter $D_1$ of the upper part of the bores $K_1$, $K_4$ that are formed in the top face 10*c* of the frame part 10 and that receive the closing members 33, 34, 35 is larger than the diameter $D_2$ of the middle part of the bores $K_1$, $K_4$, which diameter $D_2$ is again larger than the diameter $D_3$ of the bottom part of the bores $K_1$, $K_4$. The upper part of the bore, which is provided with a larger diameter $D_1$, extends a certain distance below the cross-direction bores $K_3$, $K_6$ connected with the bores $K_1$, $K_4$. At the point at which the first narrowing of the bores $K_1$, $K_4$ occurs from the diameter $D_1$ to the diameter $D_2$, a first shoulder is formed, against which the guide parts 33*a*, 34*a*, 35*a* of the closing members 33, 34, 35 are positioned. At the point at which the second narrowing of the bores $K_1$, $K_4$ from the diameter $D_2$ to the diameter $D_3$ takes place, a second shoulder is formed, against which the conical parts 33*b*, 34*b*, 35*b* of the bottom ends of the closing members 33, 34, 35 are sealed. Further, on the closing member 33, 34, 35, there is a narrowing above the guide part 33*a*, 34*a*, 35*a*, into which narrowing an O-ring is situated. When the closing member 33, 34, 35 is shifted to the upper position, the O-ring is sealed between the closing member 33, 34, 35 and the upper part of the bore $K_1$, $K_4$, in which connection, passage of the pressure medium upwards in the bore $K_1$, $K_4$ is prevented. As the closing members 33, 34, 35, it is possible to use, for example, members of a spindle type, and all of them are preferably identical.

Thus, the closing valve in accordance with the invention operates so that, when the connecting part 30 is raised or lowered in relation to the frame part 10, the closing members 33, 34, 35 attached to the connecting part 30 move in the bores provided in the frame part 10. When the connecting part 30 is placed in its uppermost position at the largest distance from the top face 10*c* of the frame part 10 of the closing valve, the closing members 33, 34, 35 open the pressure medium ducts P, T, A, B that have been formed into the frame part 10, in which connection, the pressure medium can flow between the regulation valve 101 and the block frame 100. Similarly, when the connecting part 30 is in its lowest position at the smallest distance from the top face 10*c* of the frame part 10 of the closing valve, the conical parts 33*b*, 34*b*, 35*b* at the bottom end of the closing members 33, 34, 35 close the pressure medium ducts P, T, A, B that are formed into the frame part 10, in which connection flow of the pressure medium from the block frame 100 to the regulation valve 101 is prevented.

The sealing between the closing valve and the regulation valve 101 and between the closing valve and the block frame 100 can be carried out, for example by means of gasket plates. The sealing can also be arranged, for example, by means of recesses for O-rings made to the openings in the frame part 10 and by means of O-rings to be fitted in these recesses.

The terms top face 10*c* and bottom face 10*d* of the frame part 10 have been used in the present patent application exclusively in order to illustrate the description, and these expressions do not restrict the actual physical positioning of the closing valve.

The examples provided above are not meant to be exclusive. Many other variations of the present invention would be obvious to those skilled in the art, and are contemplated to be within the scope of the appended claims. Thus, the invention has been described above only with reference to some of its advantageous embodiments. However, the invention is not intended to be narrowly confined to the disclosed embodiments. Numerous variations and modifications are possible within the scope of the inventive idea defined in the following claims.

We claim:

1. A closing valve for a regulation valve of a variable-crown roll in a paper machine, the roll including a block frame having ducts through which pressure medium is passed to the regulation valve, the closing valve comprising a frame part adapted to be arranged between the regulation valve and the block frame, said frame part including pressure medium ducts through which pressure medium flows between the block frame and the regulation valve, a connecting part movable relative to said frame part, and closing members mounted on said connecting part and arranged to extend into said pressure medium ducts in said frame part such that movement of said connecting part relative to said frame part closes and opens said pressure medium ducts in said frame part and thus controls the flow of pressure medium between the block frame and the regulation valve, guide means for guiding movement of said connecting part relative to said frame part wherein said guide means comprises elongate members connected to said frame part, said connecting part including bores through which said elongate members pass.

2. The closing valve of claim 1, wherein said frame part includes four of said pressure medium ducts, two of said pressure medium ducts having a common duct portion.

3. The closing valve of claim 2, wherein said closing members comprise three closing members, one of said closing members being arranged to extend into said common duct portion of said two pressure medium ducts and the other of said closing members being arranged to extend into a respective one of the other of said pressure medium ducts.

4. The closing valve of claim 1, wherein said closing members are fixedly attached to said connecting part.

5. The closing valve of claim 1, wherein said closing members are arranged to move into and out of said pressure medium ducts in said frame part such that all of said pressure medium ducts in said frame part are closed or opened simultaneously.

6. The closing valve of claim 1, further comprising displacement means for displacing said connecting part relative to said frame part.

7. The closing valve of claim 6, wherein said displacement means comprise a screw member attached to said connecting part, said frame part having a threaded bore for receiving said screw member such that rotation of said screw member causes displacement of said connecting part relative to said frame part.

8. The closing valve of claim 7, wherein said screw member is attached to said connecting part by means of a locking ring.

9. The closing valve of claim 1, wherein two of said pressure medium ducts each have a first bore leading to the block frame and a second bore leading to the regulation valve, said two pressure medium ducts having a common duct portion in said frame part between said first and second bores.

10. The closing valve of claim 1, wherein two of said pressure medium ducts each comprise a first bore having an opening in a first face of said frame part and leading to the block frame, a second bore having an opening in a second face of said frame part parallel to said first face and leading to the regulation valve, a third bore formed in a third face of said frame part perpendicular to said first and second faces and extending toward a fourth face of said frame part parallel to said third face, said third bore communicating with said second bore and extending beyond a communication point with said second bore, a fourth bore formed in said fourth face of said frame part and communicating with said first bore, and a fifth bore formed in said first face interconnecting said third and fourth bores.

11. The closing valve of claim 1, wherein said closing members include a conical face at one end thereof and said pressure medium ducts include a shoulder situated such that abutment of said conical face of each of said closing members against said shoulder of a respective one of said pressure medium ducts closes said pressure medium.

12. A variable-crown roll in a paper machine, comprising a plurality of regulation valves, each of said regulation valves being arranged to provide a pressure medium for causing a force to be applied against a roll mantle of the roll, a block frame having pressure medium ducts through which pressure medium is passed to said regulation valves, and a plurality of closing valves, each of said closing valves being arranged between said block frame and a respective one of said regulation valves, each of said closing valves comprising a frame part adapted to be arranged between said regulation valve and said block frame, said frame part including pressure medium ducts through which pressure medium flows between said block frame and said regulation valve, a connecting part movable relative to said frame part, and closing members mounted on said connecting part and arranged to extend into said pressure medium ducts in said frame part such that movement of said connecting part relative to said frame part closes and opens said pressure medium ducts in said frame part and thus controls the flow of pressure medium between said block frame and said regulation valve guide means for guiding movement of said connecting part relative to said frame part, wherein said guide means comprise elongate members connected to said frame part, said connecting part including bores through which said elongate members pass.

13. The variable-crown roll of claim 12, wherein said closing members are arranged to move into and out of said pressure medium ducts in said frame part such that all of said pressure medium ducts in said frame part are closed or opened simultaneously.

14. The variable-crown roll of claim 12, wherein each of said closing valves further comprises displacement means for displacing said connecting part relative to said frame part, said displacement means comprising a screw member attached to said connecting part, said frame part having a threaded bore for receiving said screw member such that rotation of said screw member causes displacement of said connecting part relative to said frame part.

15. The variable-crown roll of claim 12, wherein two of said pressure medium ducts in each of said closing valves each have a first bore leading to said block frame and a second bore leading to said regulation valve, said two pressure medium ducts having a common duct portion in said frame part between said first and second bores.

16. The variable-crown roll of claim 12, wherein two of said pressure medium ducts in each of said closing valves each comprise a first bore having an opening in a first face of said frame part and leading to said block frame, a second bore having an opening in a second face of said frame part parallel to said first face and leading to said regulation valve, a third bore formed in a third face of said frame part perpendicular to said first and second faces and extending toward a fourth face of said frame part parallel to said third face, said third bore communicating with said second bore and extending beyond a communication point with said second bore, a fourth bore formed in said fourth face of said frame part and communicating with said first bore, and a fifth bore formed in said first face interconnecting said third and fourth bores.

* * * * *

UNITED STATES PATENT AND TRADEMARK OFFICE

CERTIFICATE OF CORRECTION

PATENT NO. : 6,135,935

DATED : October 24, 2000

INVENTOR(S) :. Kivioja, Pekka et al.

It is certified that error appears in the above-identified patent and that said Letters Patent is hereby corrected as shown below:

ON THE TITLE PAGE

Inventor should read –LAHTINEN--

Signed and Sealed this

Eighth Day of May, 2001

*Attest:*

Nicholas P. Godici

NICHOLAS P. GODICI

*Attesting Officer*

*Acting Director of the United States Patent and Trademark Office*